US009097113B2

(12) United States Patent
Miyata et al.

(10) Patent No.: US 9,097,113 B2
(45) Date of Patent: Aug. 4, 2015

(54) HYDRAULIC PUMP/MOTOR AND METHOD OF SUPPRESSING PULSATION OF HYDRAULIC PUMP/MOTOR

(75) Inventors: Takahiro Miyata, Kuki (JP); Kazuhiro Maruta, Kawaguchi (JP)

(73) Assignee: Komatsu Ltd., Tokyo (JP)

( * ) Notice: Subject to any disclaimer, the term of this patent is extended or adjusted under 35 U.S.C. 154(b) by 497 days.

(21) Appl. No.: 13/635,504

(22) PCT Filed: Mar. 16, 2011

(86) PCT No.: PCT/JP2011/056252

§ 371 (c)(1),
(2), (4) Date: Nov. 27, 2012

(87) PCT Pub. No.: WO2011/115180

PCT Pub. Date: Sep. 22, 2011

(65) Prior Publication Data

US 2013/0068091 A1 Mar. 21, 2013

(30) Foreign Application Priority Data

Mar. 18, 2010 (JP) ..... 2010-063294

(51) Int. Cl.
*F04B 11/00* (2006.01)
*F01B 3/00* (2006.01)
(Continued)

(52) U.S. Cl.
CPC ..... *F01B 3/0038* (2013.01); *F04B 1/24* (2013.01); *F04B 11/005* (2013.01); *F04B 53/001* (2013.01); *F04C 29/0035* (2013.01)

(58) Field of Classification Search
CPC ..... F04C 29/0035; F04C 1/24; F04C 11/005; F04C 3/0038; F04C 53/001; F04C 11/00; F04C 39/0027
See application file for complete search history.

(56) References Cited

U.S. PATENT DOCUMENTS 2,288,768 A * 7/1942 Zimmermann ..... 91/6.5
2,963,983 A 12/1960 Wiggermann
(Continued)

FOREIGN PATENT DOCUMENTS

CN 1074019 7/1993
CN 1146793 4/1997
(Continued)

OTHER PUBLICATIONS

Office Action mailed May 28, 2014, issued for the corresponding German patent application No. 11 2011 100 941.0 and English translation thereof.
(Continued)

*Primary Examiner* — Charles Freay
*Assistant Examiner* — Philip Stimpert
(74) *Attorney, Agent, or Firm* — Locke Lord LLP

(57) ABSTRACT

A method of suppressing a pulsation of axial type hydraulic pump/motor includes performing a pressure accumulation operation in which each of ports of each of two pressure accumulation oil passages exclusively communicates with a corresponding one of communication holes and pressure inside one of the cylinder bores is accumulated in a corresponding one of the pressure accumulation oil passages through the communication hole in two levels, the communication holes being provided for each of the cylinder bores to communicate with inside of each of the cylinder bores and having opening portions sliding on the respective ports with rotation of the cylinder block to communicate with the respective ports; and performing an accumulated pressure collection operation in which the pressure accumulated in the pressure accumulation oil passage is collected in one of the cylinder bores in two levels.

9 Claims, 12 Drawing Sheets

(51) Int. Cl.

| | |
|---|---|
| ***F04B 1/24*** | (2006.01) |
| ***F04B 53/00*** | (2006.01) |
| *F04C 29/00* | (2006.01) |

(56) References Cited

U.S. PATENT DOCUMENTS

| | | | | |
|---|---|---|---|---|
| 3,179,060 | A | 4/1965 | Lehrer | |
| 3,999,466 | A | 12/1976 | Aschke | |
| 5,593,285 | A | 1/1997 | Watts | |
| 5,807,080 | A | 9/1998 | Ochiai et al. | |
| 6,086,336 | A * | 7/2000 | Welschof et al. | 417/308 |
| 2005/0180872 | A1 | 8/2005 | Esders | |
| 2008/0307956 | A1 | 12/2008 | Wright | |
| 2010/0236398 | A1 * | 9/2010 | Iida | 91/499 |

FOREIGN PATENT DOCUMENTS

| | | | |
|---|---|---|---|
| CN | 1892032 | | 1/2007 |
| CN | 101328884 | | 12/2008 |
| DE | 2333380 | C2 | 1/1975 |
| DE | 102004007933 | B3 | 6/2005 |
| JP | 07-189887 | A | 7/1995 |
| JP | 08-144941 | A | 6/1996 |
| JP | 09-256945 | A | 9/1997 |
| JP | 09-287553 | A | 11/1997 |
| JP | 09-317627 | A | 12/1997 |
| JP | 2000-045929 | A | 2/2000 |
| JP | 2005-140035 | A | 6/2005 |
| WO | WO-2009/037994 | A1 | 3/2009 |

OTHER PUBLICATIONS

International Search Report dated Apr. 12, 2011, issued for PCT/JP2011/056252.

* cited by examiner

HYDRAULIC PUMP/MOTOR AND METHOD OF SUPPRESSING PULSATION OF HYDRAULIC PUMP/MOTOR

FIELD

The present invention relates to an axial type hydraulic pump/motor capable of suppressing a pulsation generated when a low-pressure operation changes to a high-pressure operation and/or the high-pressure operation changes to the low-pressure operation and relates to a method of suppressing the pulsation of the axial type hydraulic pump/motor.

BACKGROUND

Hitherto, in a construction machine and the like, an axial type hydraulic piston pump which is driven by an engine or an axial type hydraulic piston motor which is driven by pressure oil has been frequently used.

For example, the axial type hydraulic piston pump includes a cylinder block which is provided so as to rotate along with a rotation shaft rotatably provided inside a casing and is provided with a plurality of cylinders spaced from each other in the circumferential direction and extending in the axial direction, a plurality of pistons which are slidably inserted and fitted into the respective cylinders of the cylinder block and move in the axial direction with the rotation of the cylinder block so as to suction and discharge hydraulic oil, and a valve plate which is provided between the casing and an end surface of the cylinder block and is provided with a suction port and an ejection port communicating with the respective cylinders. Then, in the hydraulic pump, when a drive shaft is rotationally driven, the cylinder block rotates inside the casing along with an operation shaft, pistons reciprocate inside the respective cylinders of the cylinder block, and the hydraulic oil suctioned from the suction port into the cylinder is pressurized by the piston, whereby the hydraulic oil is discharged as pressure oil in the ejection port.

Here, when the cylinder port of each cylinder communicates with the suction port of the valve plate, the piston moves in a direction protruding from the cylinder from the start end of the suction port to the terminal end thereof and an intake operation is performed in which the hydraulic oil is suctioned from the suction port into the cylinder. On the other hand, when the cylinder port of each cylinder communicates with the ejection port, the piston moves in a direction entering the cylinder from the start end of the ejection port to the terminal end thereof and a delivery operation is performed in which the hydraulic oil inside the cylinder is discharged into the ejection port. Then, when the cylinder block rotates so as to repeat the suction operation and the delivery operation, the hydraulic oil which is suctioned into the cylinder from the suction port by the suction operation is pressurized by the delivery operation so as to be ejected in the ejection port.

CITATION LIST

Patent Literature

Patent Literature 1: Japanese Laid-open Patent Publication No. 07-189887

Patent Literature 2: Japanese Laid-open Patent Publication No. 08-144941

SUMMARY

Technical Problem

Here, in the hydraulic pump and the like of the related art, the inside of the cylinder which suctions the hydraulic oil through the suction port of the valve plate by the suction operation becomes a low-pressure state. When the cylinder port of each cylinder communicates with the ejection port, the high-pressure oil inside the ejection port abruptly flows into the low-pressure cylinder through the cylinder port so as to cause a large change in pressure. Due to the change in pressure, a pulsation is generated, and hence there is a problem that vibration or noise occurs.

In order to solve this problem, in Patent Literature 1, the valve plate is provided with a first notched groove which communicates with the cylinder port when the communication between the suction port and the cylinder port positioned near the terminal end of the suction port among the cylinder ports of the respective cylinders is disconnected. Further, a second notched groove is provided which communicates with the cylinder port when the communication between the ejection port and the cylinder port positioned near the terminal end of the ejection port is disconnected. Then, the hydraulic pump suppresses a pulsation generated by a change in pressure by the continuous communication of the first notched groove and the second notched groove through the communication passage.

Further, in Patent Literature 2, a notch is formed at the entrance side of the ejection port with respect to the cylinder port, a conduit is formed so as to be connected from the suction port in front of the notch to the ejection port, and a chamber is provided in the middle of the conduit. In addition, a check valve is provided in the conduit of the portion connecting the ejection port to the chamber so as to permit the circulation of a fluid from the ejection port to the chamber. Accordingly, in the hydraulic pump, a high pressure is supplied from the chamber into the cylinder before the cylinder port reaches the ejection port, and a decrease in pressure of the chamber is replenished from the ejection port through the check valve, thereby reducing a pulsation in the ejection port due to the reverse flow of the high-pressure fluid from the ejection port into the cylinder when the cylinder port directly communicates with the ejection port.

However, in Patent Literature 1, the pressure inside the cylinder is raised before the cylinder port communicates with the ejection port. However, since the pressure is raised only by the remaining pressure inside the high pressure side cylinder, the pressure is not sufficiently raised. For example, the pressure is raised by a differential pressure of about ⅓. As a result, since there is a large difference between the pressure inside the cylinder and the pressure of the ejection port, there is a problem that a pulsation is generated in the ejection port due to the reverse flow of the high-pressure fluid into the cylinder when communicating with the ejection port depending on the number of rotations.

Further, in Patent Literature 2, the chamber and the check valve are provided. However, this configuration has problems that the configuration itself is complex and a pulsation is generated in the ejection port due to the reverse flow of the high-pressure fluid in the cylinder when communicating with the ejection port depending on the number of rotations as in Patent Literature 1.

The invention is made in view of the above-described circumstances, and it is an object to provide hydraulic pump/motor capable of suppressing a pulsation with a simple configuration and a method of suppressing the pulsation of the hydraulic pump/motor.

Solution to Problem

To overcome the problems and achieve the object, according to the present invention, an axial type hydraulic pump/motor in which a cylinder block provided with a plurality of cylinder bores slides on a valve plate provided with suction and delivery ports and pistons reciprocate inside the respective cylinder bores to rotate an output shaft or an input shaft rotates to discharge hydraulic oil from the suction and delivery ports, the hydraulic pump/motor comprises: two pressure accumulation oil passages which accumulate pressure in two connected passages that are obtained in a manner such that, among two pairs of ports provided on the valve plate and provided at a top dead center side and a bottom dead center side outside a slide and rotation trajectory area of the cylinder bores, a top dead center side port on a front side in a rotation direction of the cylinder block is connected to a bottom dead center side port on the front side in the rotation direction and a top dead center side port on a rear side in the rotation direction is connected to a bottom dead center side port on the rear side in the rotation direction, wherein the cylinder block includes two communication holes which are provided for each of the cylinder bores to communicate with inside of each of the cylinder bores and of which opening portions slide on the respective ports with rotation of the cylinder block to communicate with the respective ports, and wherein each of the ports of each of the pressure accumulation oil passages exclusively communicates with the communication hole such that performed are a pressure accumulation operation in which pressure inside of one of the cylinder bores is accumulated in two levels in a corresponding one of the pressure accumulation oil passages through the communication hole and an accumulated pressure collection operation in which the pressure accumulated in the pressure accumulation oil passage is collected in two levels in one of the cylinder bores.

According to the present invention, the pressure accumulation operation and/or the accumulated pressure collection operation are performed by using the communication holes of the adjacent cylinder bores.

According to the present invention, the pressure accumulation operation and/or the accumulated pressure collection operation are performed when the cylinder bore is present in a confining area.

According to the present invention, the pressure accumulation operation is performed by simultaneously communicating a high pressure side port, the cylinder bore, and the pressure accumulation oil passage with one another.

According to the present invention, the ports of the pressure accumulation oil passage and the communication holes of the cylinder bore have a same arrangement relation in a different rotation direction of the cylinder block.

According to the present invention, an arc length between the two communication holes is longer than an arc length between the pair of ports.

According to the present invention, the number of the cylinder bores is an odd number, and the pair of ports is disposed to be point-symmetrical to each other with respect to a rotation center.

According to the present invention, an axial type hydraulic pump/motor in which a cylinder block provided with a plurality of cylinder bores slides on a valve plate provided with suction and delivery ports and pistons reciprocate inside the respective cylinder bores to rotate an output shaft or an input shaft rotates to discharge hydraulic oil from the suction and delivery ports, wherein the valve plate includes a first port which is provided at a position communicating with the cylinder bore before the cylinder bore reaches a bottom dead center and immediately before the cylinder bore disconnects from the suction and delivery port, outside a slide and rotation trajectory area of the cylinder bore in a confining area of a bottom dead center side between the suction and delivery ports, a second port which is provided at a position communicating with the cylinder bore after the cylinder bore reaches the bottom dead center and immediately before the cylinder bore communicates with the suction and delivery port and communicating with a following one of the cylinder bores adjacent to the cylinder bore to be present on a same circumference as that of the first port, outside the slide and rotation trajectory area of the cylinder bore in the confining area of the bottom dead center side between the suction and delivery ports, a third port which is provided at a position communicating with the cylinder bore to be present on the same circumference as that of the first port before the cylinder bore reaches the top dead center and immediately before the cylinder bore disconnects from the suction and delivery port, outside the slide and rotation trajectory area of the cylinder bore in a confining area of a top dead center side between the suction and delivery ports, and a fourth port which is provided at a position communicating with the cylinder bore after the cylinder bore reaches the top dead center and immediately before the cylinder bore communicates with the suction and delivery port and communicating with the following cylinder bore adjacent to the cylinder bore to be present on the same circumference as that of the first port, outside the slide and rotation trajectory area of the cylinder bore in the confining area of the top dead center side between the suction and delivery ports, wherein the cylinder block includes two communication holes which are provided for each of the cylinder bores and communicate with the inside of the cylinder bore so that openings of the communication holes near the valve plate are provided at the same circumference as those of the first to fourth ports and in which an arc length between the openings is longer than an arc length between the first and second ports and an arc length between the third and fourth ports, a first pressure accumulation oil passage which communicates the first port with the third port, and a second pressure accumulation oil passage which communicates the second port with the fourth port.

According to the present invention, a method of suppressing a pulsation of axial type hydraulic pump/motor in which a cylinder block provided with a plurality of cylinder bores slides on a valve plate provided with suction and delivery ports and pistons reciprocate inside the respective cylinder bores to rotate an output shaft or an input shaft rotates to discharge hydraulic oil from the suction and delivery ports, the method comprising: performing a pressure accumulation operation in which each of ports of each of two pressure accumulation oil passages exclusively communicates with a corresponding one of communication holes and pressure inside one of the cylinder bores is accumulated in a corresponding one of the pressure accumulation oil passages through the communication hole in two levels, the two pressure accumulation oil passages being used to accumulate pressure in two connected passages that are obtained in a manner such that, among two pairs of ports provided on the valve plate and provided at a top dead center side and a bottom dead center side outside a slide and rotation trajectory area of the cylinder bores, a top dead center side port on a front side in a rotation direction of the cylinder block is connected to a bottom dead center side port on the front side in the rotation direction and a top dead center side port on a rear side in the rotation direction is connected to a bottom dead center side port on the rear side in the rotation direction, the two communication holes being provided for each of the cylinder bores to communicate with inside of each of the cylinder bores and having opening portions sliding on the respective ports with rotation of the cylinder block to communicate with the respective ports; and performing an accumulated pressure collection operation in which the pressure accumulated in the pressure accumulation oil passage is collected in one of the cylinder bores in two levels.

Advantageous Effects of Invention

According to the invention, two pressure accumulation oil passages are provided which accumulate pressure in two connected passages that are obtained in a manner such that, among two pairs of ports provided on the valve plate and provided at a top dead center side and a bottom dead center side outside a slide and rotation trajectory area of the cylinder bores, a top dead center side port on a front side in a rotation direction of the cylinder block is connected to a bottom dead center side port on the front side in the rotation direction and a top dead center side port on a rear side in the rotation direction is connected to a bottom dead center side port on the rear side in the rotation direction, wherein the cylinder block includes two communication holes which are provided for each of the cylinder bores to communicate with inside of each of the cylinder bores and of which opening portions slide on the respective ports with rotation of the cylinder block to communicate with the respective ports, and wherein each of the ports of each of the pressure accumulation oil passages exclusively communicates with the communication hole such that performed are a pressure accumulation operation in which pressure inside of one of the cylinder bores is accumulated in two levels in a corresponding one of the pressure accumulation oil passages through the communication hole and an accumulated pressure collection operation in which the pressure accumulated in the pressure accumulation oil passage is collected in two levels in one of the cylinder bores. Accordingly, the pulsation may be suppressed with a simple configuration.

DESCRIPTION OF EMBODIMENTS

Figure 1:
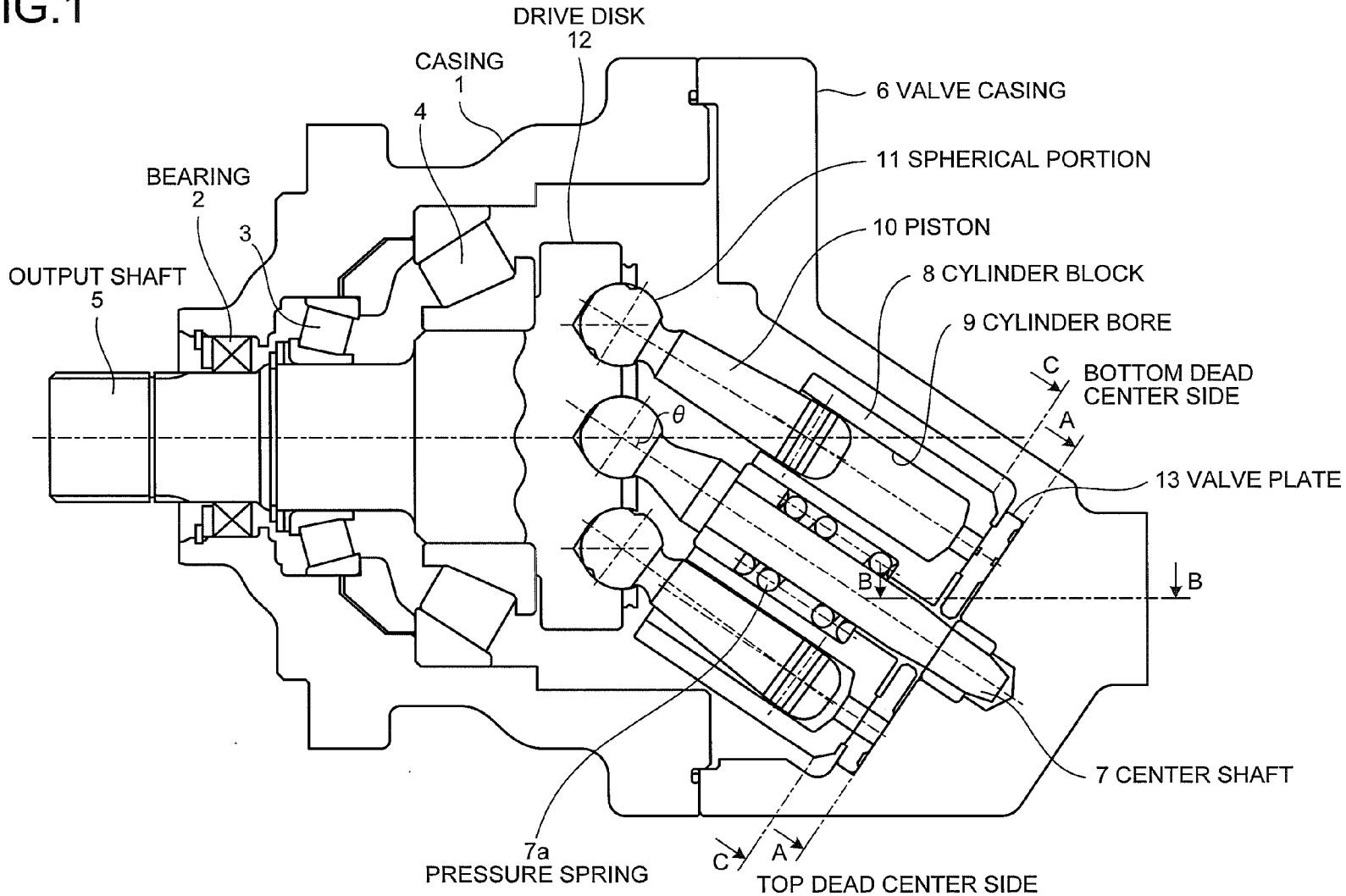
FIG. 1 is a cross-sectional view illustrating a brief configuration of a hydraulic motor according to an embodiment of the invention.

Hereinafter, referring to the drawings, hydraulic pump/motor and a method of suppressing the pulsation of the hydraulic pump/motor as a best mode for carrying out the invention will be described.

Figure 2:
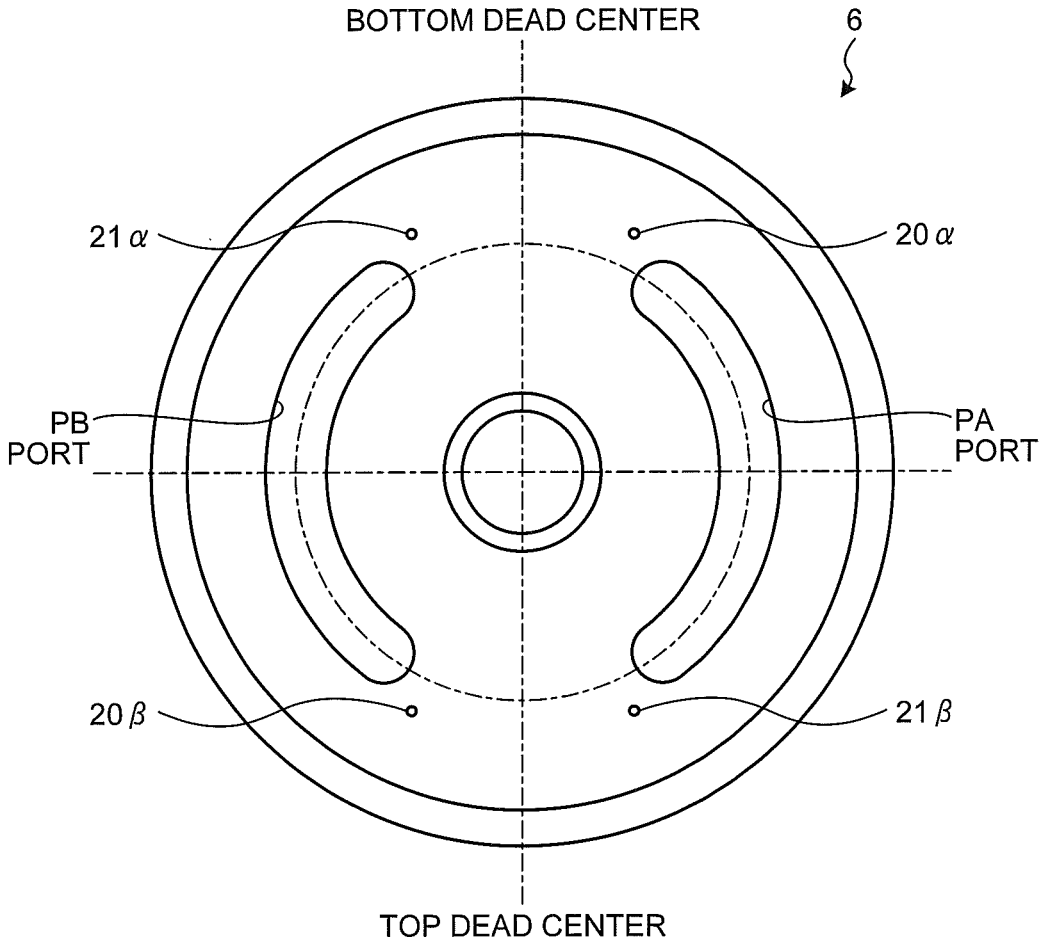
FIG. 2 is a cross-sectional view taken along the line A-A of FIG. 1.
Figure 3:
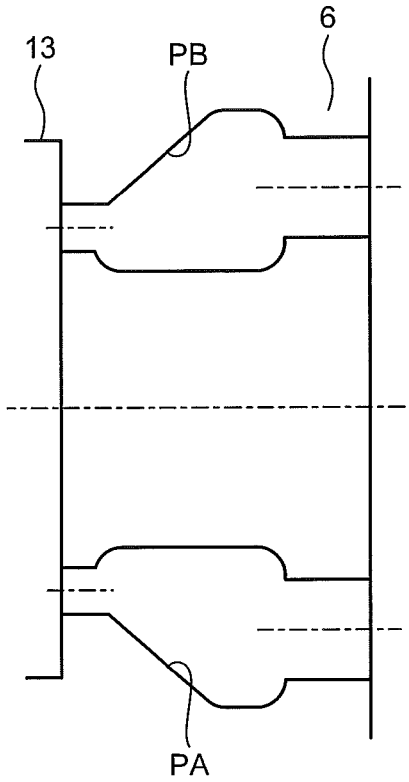
FIG. 3 is a cross-sectional view taken along the line B-B of FIG. 1.
Figure 4:
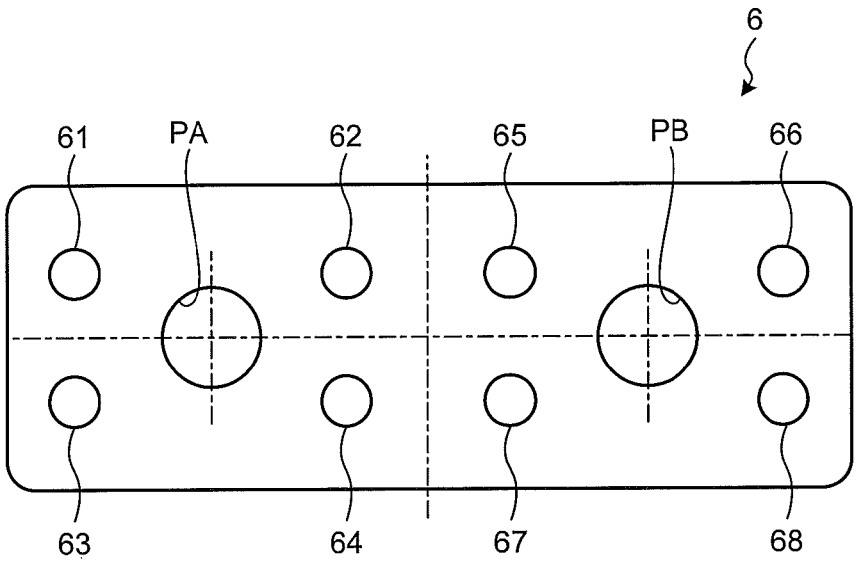
FIG. 4 is a diagram illustrating a configuration around a port when seen from the right side face of FIG. 1.

FIG. 1 is a cross-sectional view illustrating a brief configuration of a hydraulic motor according to an embodiment of the invention. Further, FIG. 2 is a cross-sectional view taken along the line A-A of FIG. 1. Further, FIG. 3 is a cross-sectional view taken along the line B-B of FIG. 1. Further, FIG. 4 is a diagram illustrating a configuration around a port when seen from the right side face of FIG. 1. The hydraulic motor illustrated in FIGS. 1 to 4 is an oblique shaft type hydraulic motor.

The hydraulic motor includes an output shaft 5 which is rotatably journaled to a casing 1 through bearings 2 to 4. Further, the hydraulic motor includes a cylinder block 8 which is provided inside a valve casing 6 so as to rotate about a center shaft 7. The casing 1 and the valve casing form a casing which is integrated by sealing. The cylinder block 8 is provided with a plurality of cylinder bores 9 which are formed in the axial direction of the center shaft 7 and a piston 10 is slidably provided inside each of the cylinder bores 9. The front end of each piston 10 is provided with a spherical portion 11, and the spherical portion 11 is slidably supported to a drive disk 12 which is provided in one end of the output shaft 5 inside the casing 1. The spherical portion 11 is supported to the drive disk 12 so as to be slidable about the axis while corresponding to the position of each piston 10. Accordingly, the piston 10 slides inside the cylinder bore 9 with the rotation of the cylinder block 8, and the output shaft 5 rotates through the drive disk 12. Here, the axis of the output shaft 5 and the axis of the center shaft 7 are inclined by an angle θ. Furthermore, the output shaft 5 becomes an input shaft when the hydraulic motor serves as a hydraulic pump.

A valve plate 13 is provided between the cylinder block 8 and the valve casing 6. As for the valve plate 13, one side surface comes into slidable contact with the bottom portion of the cylinder block 8, and the other side surface is fixed to the valve casing 6. Furthermore, the cylinder block 8 is pressed toward the valve plate 13 by a pressure spring 7*a* which is provided around the center shaft 7. The valve plate 13 is positioned in the radial direction and the circumferential direction with respect to the valve casing 6. Furthermore, as illustrated in FIG. 2, the side of the valve casing 6 near the valve plate 13 is provided with respective both-end openings 20α and 20β and both-end openings 21α and 21β of pressure accumulation oil passages 20 and 21 which are respectively connected to ports 20*a* and 20*b* and ports 21*a* and 21*b* of the pressure accumulation oil passages 20 and 21 to be described later. As illustrated in FIGS. 3 and 4, the side of the valve casing 6 near the valve plate 13 is provided with ports PA and PB (the suction and delivery ports) into which high-pressure hydraulic oil flows from the outside and from which low-pressure hydraulic oil is discharged to the outside. The suction and delivery ports PA and PB are respectively formed on the side of the valve plate 13 in a cocoon shape as illustrated in FIG. 2 and are respectively formed in a circular opening at the outside of the valve casing 6 as illustrated in FIG. 4. For this reason, the suction and delivery ports PA and PB inside the valve casing 6 are formed in an inner tube shape so that hydraulic oil smoothly moves between the cocoon-like opening and the circular opening as illustrated in FIG. 3. Furthermore, the vicinity of the suction and delivery ports PA and PB at the outside of the valve casing 6 are provided with holes 61, 62, 63, 64, 65, 66, 67, and 68 into which bolts for split flanges are inserted as illustrated in FIG. 4.

Figure 5:
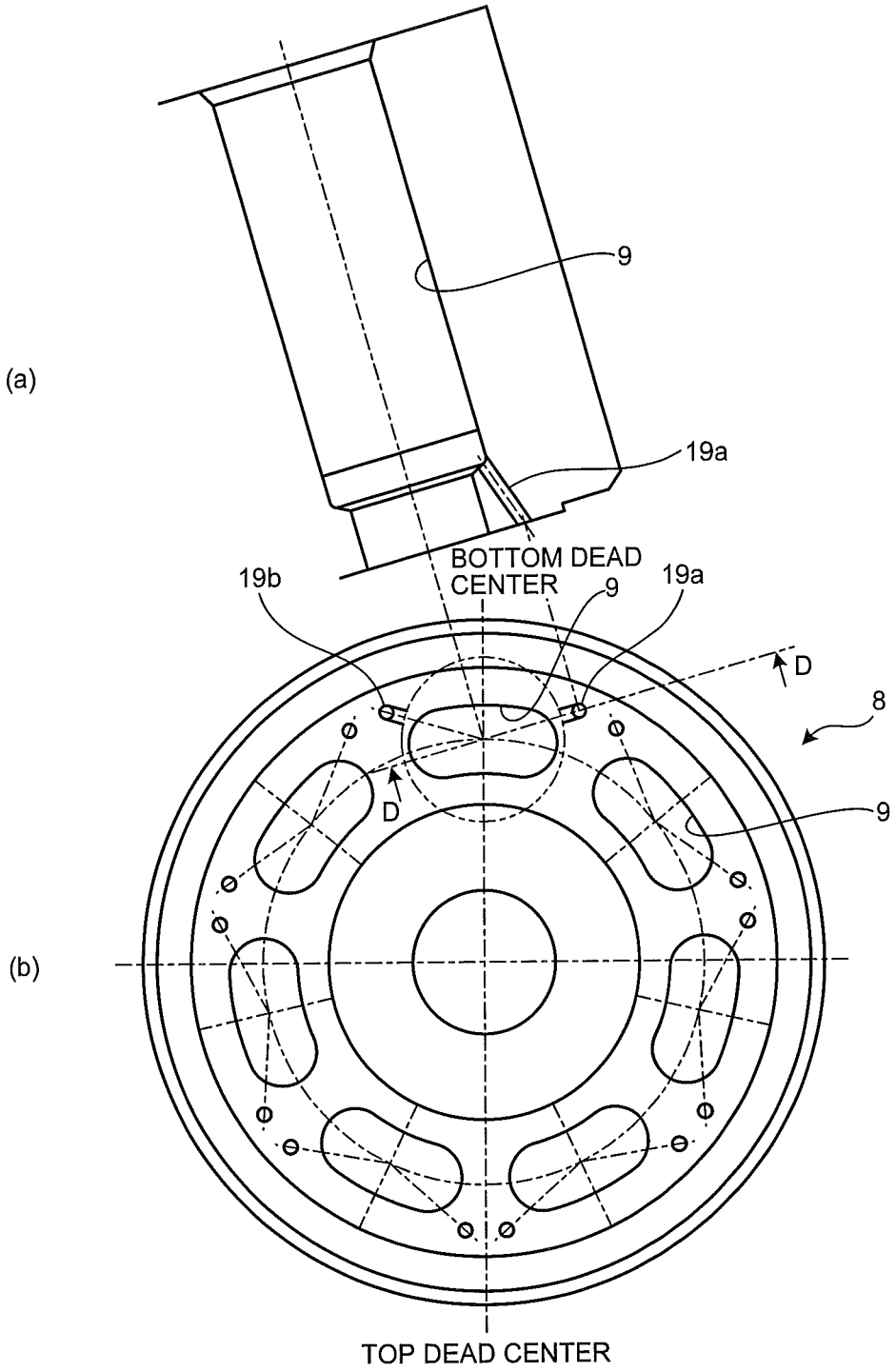
FIG. 5 is a diagram illustrating a specific configuration of a cylinder block.
Figure 6:
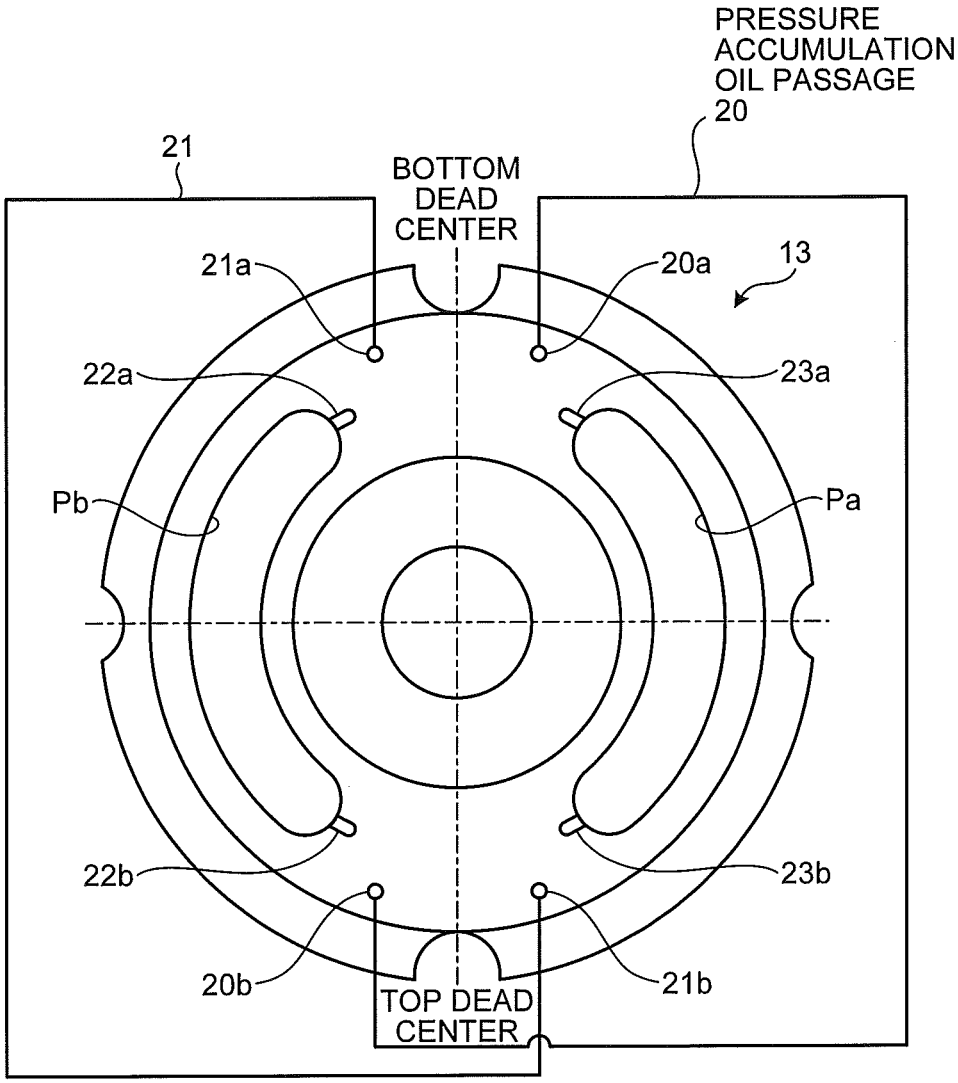
FIG. 6 is a diagram illustrating a configuration of a valve plate when seen from an output shaft 5 of a center shaft 7.

FIG. 5 illustrates a configuration of the cylinder block 8, where FIG. 5(*b*) is a cross-sectional view taken along the line C-C of FIG. 1, and FIG. 5(*a*) is a cross-sectional view taken along the line D-D of FIG. 5(*b*). Further, FIG. 6 is a diagram illustrating a configuration of the valve plate 13 when seen from the output shaft 5 of the center shaft 7. As illustrated in FIG. 5, the bottom portion of the cylinder block 8 is provided with a plurality of openings of the cylinder bores 9 corresponding to the arrangement of the pistons 10. On the other hand, the valve plate 13 is provided with ports Pa and Pb corresponding to the respective cocoon-like ports PA and PB illustrated in FIG. 2. Then, the respective cylinder bores 9 intermittently communicate with the respective ports Pa and Pb by the rotation of the cylinder block 8.

Here, when the high-pressure hydraulic oil flows from the port Pb, the hydraulic oil flows into the cylinder bore 9 communicating with the port Pb, and pressurizes the inside of the cylinder bore 9, whereby the piston 10 is pushed out and the piston 10 near the port Pb rotates from the top dead center to the bottom dead center. As a result, in a state where the cylinder block 8 is seen from the output shaft 5, the cylinder block 8 rotates rightward about the axis of the center shaft 7 and the output shaft 5 rotates rightward. On the other hand, when the high-pressure hydraulic oil flows into the port Pa, the cylinder block 8 and the output shaft 5 rotate leftward.

Here, in the cylinder block 8, two communication holes 19*a* and 19*b* are obliquely formed in the respective cylinder bores 9 so as to communicate with the inside of the cylinder bore 9 separately from the bottom opening of the cylinder bore 9. The opening positions of the communication holes 19*a* and 19*b* are arranged in the circumferential direction so as to have a large diameter in relation to the outermost peripheral position of the opening of the cylinder bore 9. Further, the opening positions of the respective communication holes 19*a* and 19*b* are provided at positions which are symmetrical with respect to the diameter passing the centers of the cylinder bores 9, and the distances of the arcs between the respective communication holes 19*a* and 19*b* are identical. Furthermore, it is desirable that the opening shapes of the respective communication holes 19*a* and 19*b* are circular.

On the other hand, in the valve plate 13 which comes into slidable contact with the bottom portion of the cylinder block 8, the rotation diameters of the respective communication holes 19*a* and 19*b* are equal to each other, and ports 20*a*, 20*b*, 21*a*, and 21*b* each of which the side of the cylinder block 8 is opened are arranged in the circumferential direction. The ports 20*a* and 21*a* are disposed at positions symmetrical to each other with respect to the line connecting the top dead center and the bottom dead center to each other at the bottom dead center, and the distance between the ports 20*a* and 21*a* is set to be shorter than the distance of the arc between the respective communication holes 19*a* and 19*b*. Similarly, the ports 20*b* and 21*b* are disposed at positions symmetrical to each other with respect to the line connecting the top dead center and the bottom dead center to each other at the top dead center, and the distance between the ports 20*b* and 21*b* is shorter than the distance of the arc between the respective communication holes 19*a* and 19*b* and is equal to the distance between the ports 20*a* and 20*b*. Further, the ports 20*a* and 21*b* are provided at the side of the port Pa, and the ports 21*a* and 20*b* are provided at the side of the port Pb. Furthermore, it is desirable that the ports 20*a*, 20*b*, 21*a*, and 21*b* have a circular opening shape and have the same shape and size as those of the respective communication holes 19*a* and 19*b*.

Here, a pressure accumulation oil passage 20 is provided between the port 20*a* and the port 20*b* so as to communicate with the respective ports 20*a* and 20*b* and to temporarily accumulate the pressure of the hydraulic oil. Further, a pressure accumulation oil passage 21 is provided between the port 21*a* and the port 21*b* so as to communicate with the respective ports 21*a* and 21*b* and to temporarily accumulate the pressure of the hydraulic oil. The pressure accumulation oil passages 20 and 21 may be formed inside the valve casing 6 and may be also formed inside the valve plate 13. Then, the pressure accumulation oil passages 20 and 21 may be passages which may endure the pressure of the high pressure side hydraulic oil contained in the cylinder bore 9. Further, the pressure accumulation oil passages 20 and 21 may accumulate pressure, may have a short length, and may be a passage having the shortest distance.

Further, respective notches 23*a*, 23*b*, 22*a*, and 22*b* are formed in both circumferential end portions of the opening near the cylinder block 8 of the respective ports Pa and Pb of the valve plate 13. The respective notches 23*a*, 23*b*, 22*a*, and 22*b* have a relay function of transmitting pressure from the notch to the communication hole present at a far position when the cylinder bores 9 separate from the ports Pa and Pb and have a function of alleviating a change in the pressure of the cylinder bore 9 when the cylinder bores 9 communicate with the ports Pa and Pb.

Here, referring to FIGS. 7 to 13, the pressure accumulation operation with respect to the pressure accumulation oil passages 20 and 21 and the accumulated pressure collection operation from the pressure accumulation oil passages 20 and 21 to the cylinder bore in a case where the high-pressure hydraulic oil is supplied to the port Pb and the cylinder block 8 rotates rightward will be described. FIGS. 7 to 12 illustrate the communication arrangement of the respective portions with the rightward rotation of the cylinder block. Further, FIG. 13 is a time chart illustrating a change in the pressure of the respective portions with the rightward rotation of the cylinder block.

Figure 7:
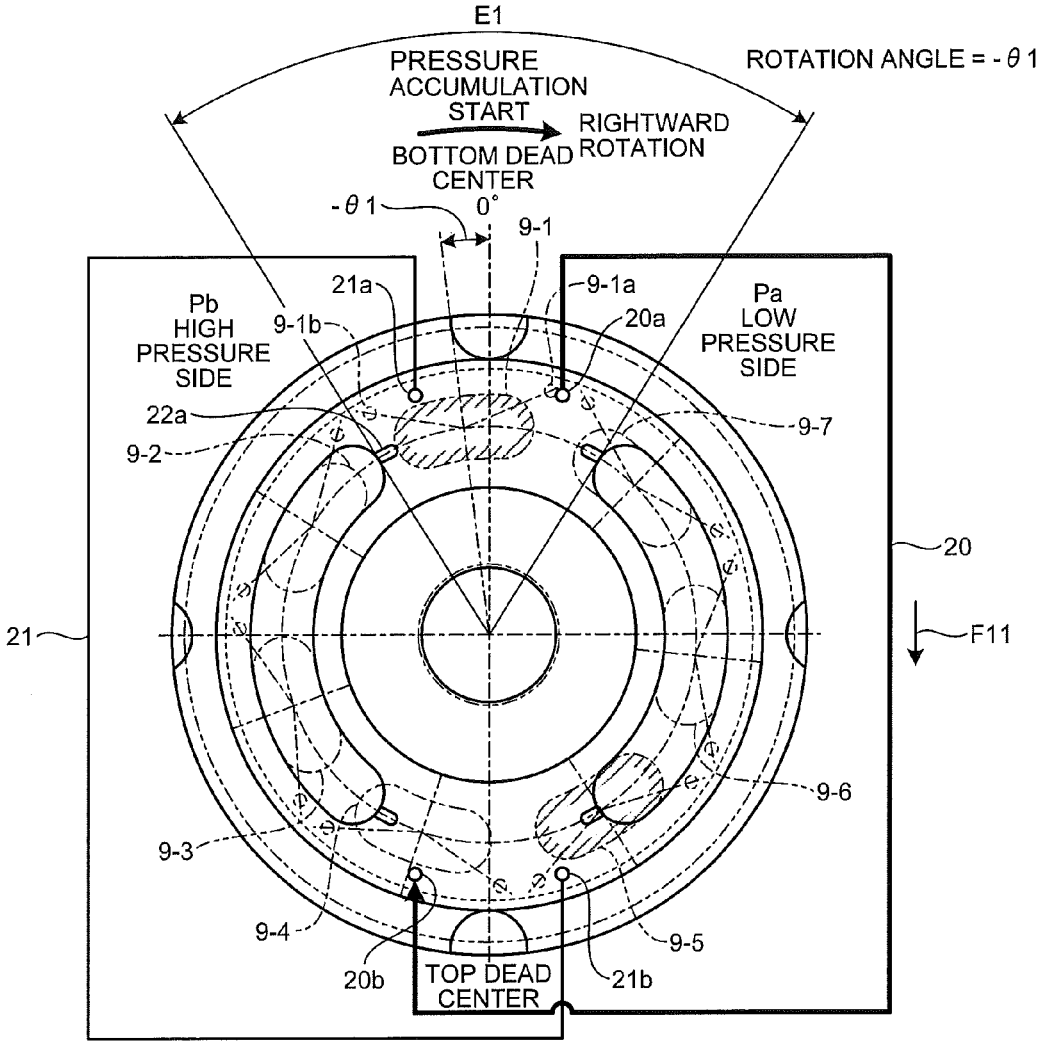
FIG. 7 is a diagram illustrating a positional relation between the valve plate and the cylinder block when an angle obtained by rotating the cylinder block rightward is −θ1.

First, as illustrated in FIG. 7, when the rightward rotation angle is set with the bottom dead center of 0° and the angle between the bottom dead center and the opening center of the cylinder bore 9-1 among the cylinder bores 9-1 to 9-7 becomes −θ1, even if the cylinder bore 9-1 is in a confining area E1 where the oil inside the cylinder bore is confined between the cylinder bore and the valve plate 13, the communication between the cylinder bore 9-1 and the port Pb is maintained through the notch 22*a* of the port Pb. Here, the communication holes 9-1*a* and 9-1*b* are holes communicating with the inside of the cylinder bore 9-1. Then, among the communication holes 9-1*a* and 9-1*b*, the communication hole 9-1*a* in the rightward rotation direction communicates with the port 20*a* of the pressure accumulation oil passage. As a result, the port Pb and the pressure accumulation oil passage 20 communicate with each other through the port Pb, the notch 22*a*, the cylinder bore 9-1, the communication hole 9-1*a*, and the port 20*a*, and since the port 20*b* of the other end of the pressure accumulation oil passage 20 is blocked, the pressure of the port Pb is accumulated inside the pressure accumulation oil passage 20. That is, a pressure accumulation operation F11 is performed. The pressure inside the pressure accumulation oil passage 20 becomes equal to the pressure of the port Pb by the pressure accumulation operation F11.

Figure 8:
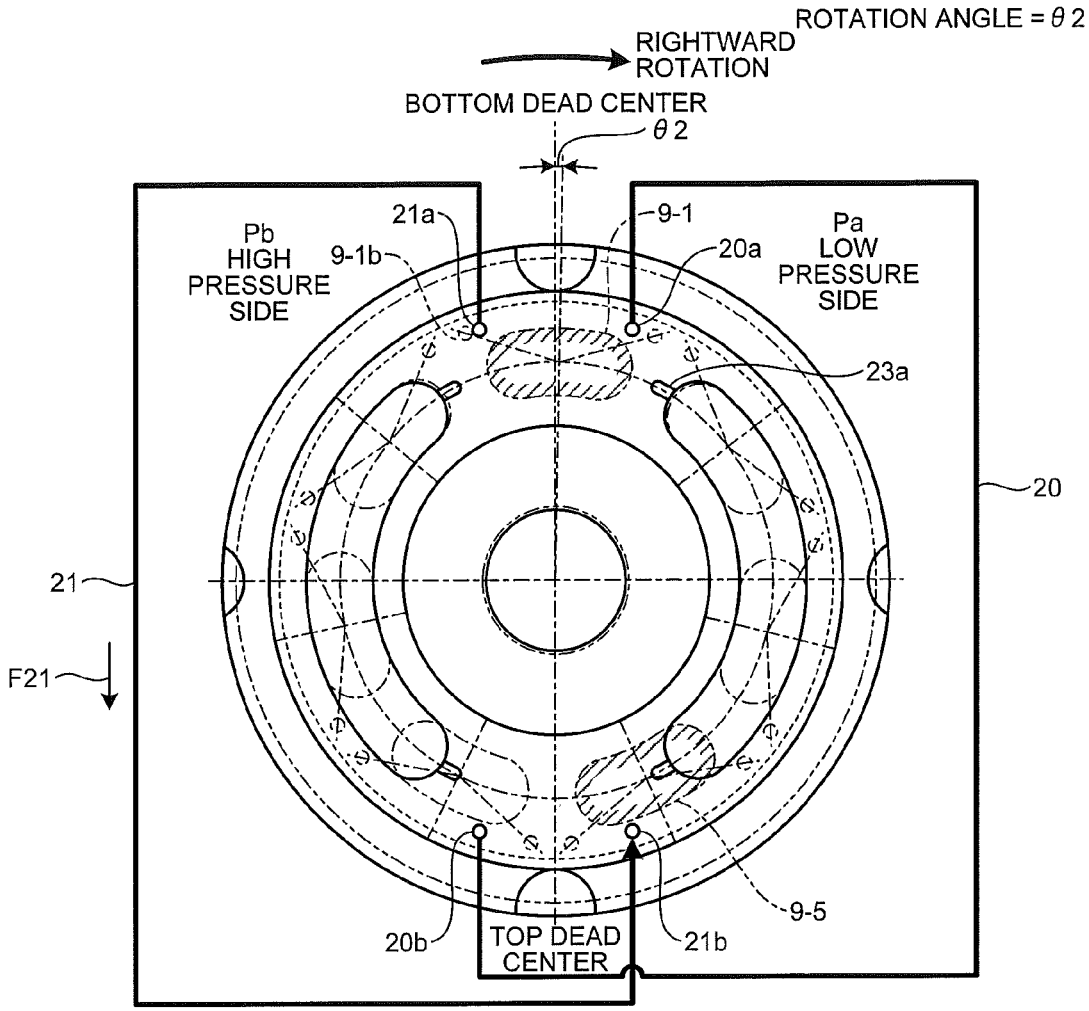
FIG. 8 is a diagram illustrating a positional relation between the valve plate and the cylinder block when an angle obtained by rotating the cylinder block rightward is θ2.

Subsequently, as illustrated in FIG. 8, when the cylinder block 8 further rotates rightward and the angle of the opening center of the cylinder bore 9-1 becomes θ2, the cylinder bore 9-1 is positioned at the confining area E1, but the communication hole 9-1*b* of the cylinder bore 9-1 communicates with the port 21*a* of the pressure accumulation oil passage 21. On the other hand, since the port 21*b* of the other end of the pressure accumulation oil passage 21 is blocked, the pressure inside the cylinder bore 9-1 being in a high-pressure state is accumulated inside the pressure accumulation oil passage 21 through the port 21*a*. That is, a pressure accumulation operation F21 is performed. In this case, since the pressure inside the pressure accumulation oil passage 21 and the pressure inside the cylinder bore 9-1 become a balanced state, the pressure rising inside the pressure accumulation oil passage 21 becomes about ½ of the pressure inside the cylinder bore 9-1 (see FIG. 13). Subsequently, when the angle of the opening center of the cylinder bore 9-1 becomes θ2*a*, the cylinder bore 9-1 communicates with the notch 23*a* of the port Pa, and the pressure inside the cylinder bore 9-1 becomes the pressure of the low-pressure port Pa.

Figure 9:
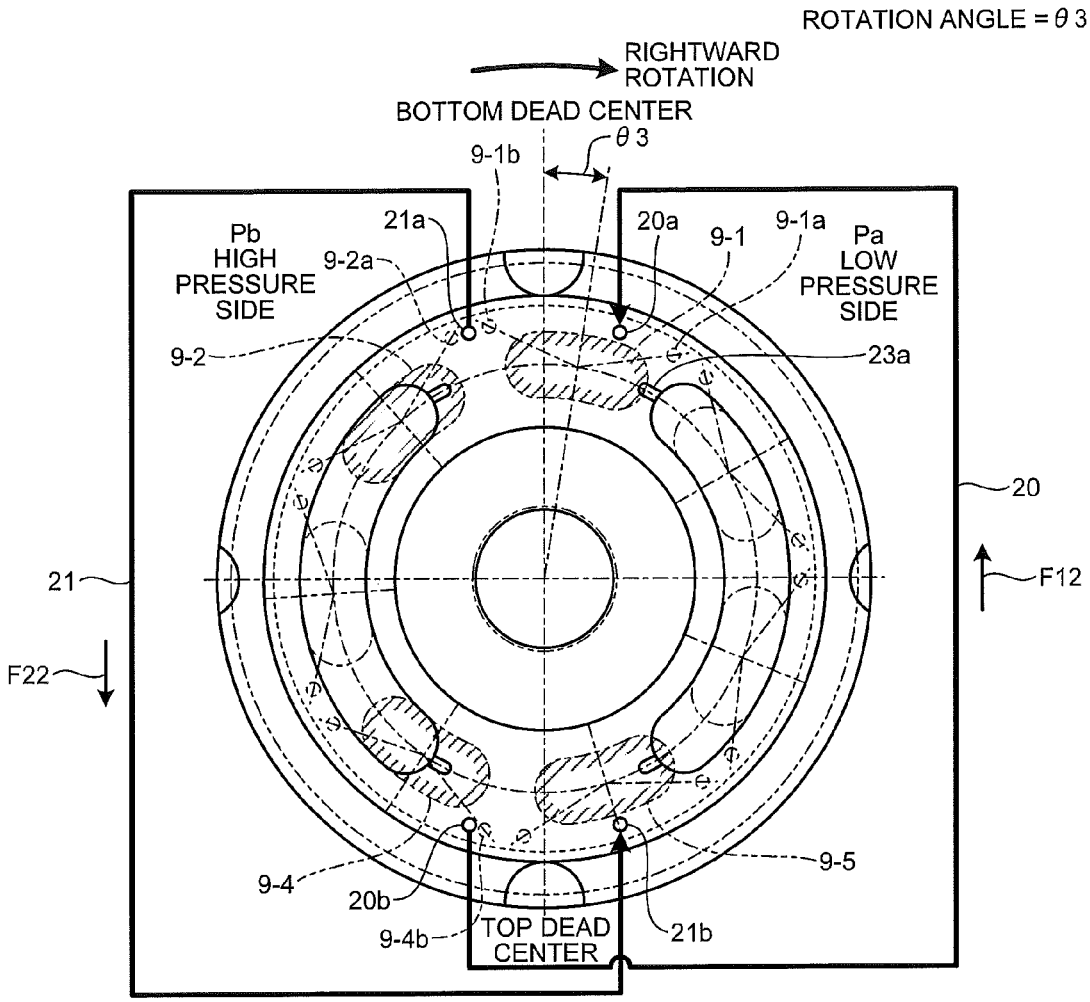
FIG. 9 is a diagram illustrating a positional relation between the valve plate and the cylinder block when an angle obtained by rotating the cylinder block rightward is θ3.

Subsequently, as illustrated in FIG. 9, when the cylinder block 8 further rotates rightward and the angle of the opening center of the cylinder bore 9-1 becomes θ3, the cylinder bore 9-1 continuously communicates with the notch 23*a* and becomes the pressure of the low-pressure port Pa as described above. On the other hand, the communication hole 9-2*a* which is positioned at the rightward rotation direction of the cylinder bore 9-2 positioned at the rear rotation side of the cylinder bore 9-1 communicates with the high pressure side of the valve plate 13, that is, the port 21*a* on the side of the port Pb, and since the port 21*b* of the other end of the pressure accumulation oil passage 21 is blocked, the pressure inside the pressure accumulation oil passage 21 is further pressurized by the pressure of the port Pb and rises in pressure to the pressure as that of the port Pb. Then, the pressure rising state is maintained. That is, a pressure accumulation operation F22 is performed. Furthermore, at the angle θ3, the communication hole 9-4*b* which is positioned at the rear rotation side of the cylinder bore 9-4 preceding the cylinder bore 9-5 communicates with the port 20*b* of the pressure accumulation oil passage 20, and since the port 20*a* of the other end is blocked, the pressure inside the pressure accumulation oil passage 20 is pressurized to the pressure inside the port Pb, and the pressure inside the port Pb is maintained. That is, a pressure accumulation operation F12 is performed.

In this way, the pressures inside the pressure accumulation oil passages 20 and 21 are respectively pressurized in two levels, and when the cylinder bore 9-1 moves from the high pressure side port Pb to the low pressure side port Pa, the pressure inside the cylinder bore 9-1 is depressurized in two levels. Accordingly, since an abrupt change in pressure does not occur, the pulsation of the hydraulic oil may be suppressed. Subsequently, the pressures accumulated in the respective pressure accumulation oil passages 20 and 21 are used for the pressure rising operation of the pressure inside the cylinder bore 9-5, and an accumulated pressure collection operation is performed.

Figure 10:
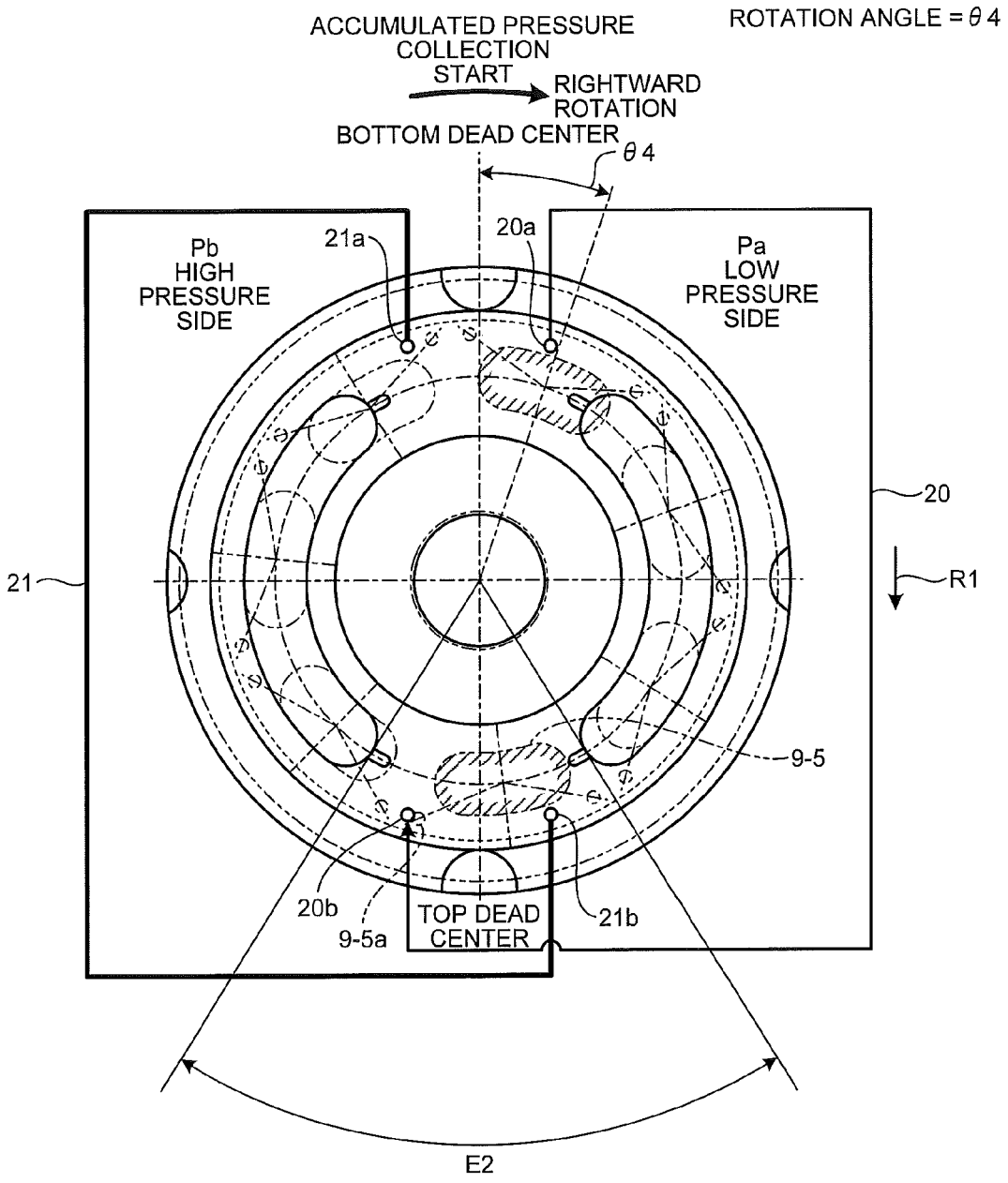
FIG. 10 is a diagram illustrating a positional relation between the valve plate and the cylinder block when an angle obtained by rotating the cylinder block rightward is θ4.

That is, as illustrated in FIG. 10, when the cylinder block 8 further rotates rightward and the angle of the opening center of the cylinder bore 9-1 becomes θ4, the cylinder bore 9-5 is positioned at a confining area E2, and the communication hole 9-5*a* in the rightward rotation direction of the cylinder bore 9-5 communicates with the port 20*b* of the pressure accumulation oil passage 20. Since the port 20*a* of the other end of the pressure accumulation oil passage 20 is blocked, the pressure which is accumulated in the pressure accumulation oil passage 20 is supplied into the cylinder bore 9-5 through the communication hole 9-5*a* so as to increase the pressure. That is, an accumulated pressure collection operation R1 is performed. As for the pressure rising operation in this case, since the pressure inside the pressure accumulation oil passage 20 and the pressure inside the cylinder bore 9-5 become a balanced state, the pressure inside the pressure accumulation oil passage 20 and the pressure inside the cylinder bore 9-5 become about ½ of the pressure accumulated inside the pressure accumulation oil passage 20.

Figure 11:
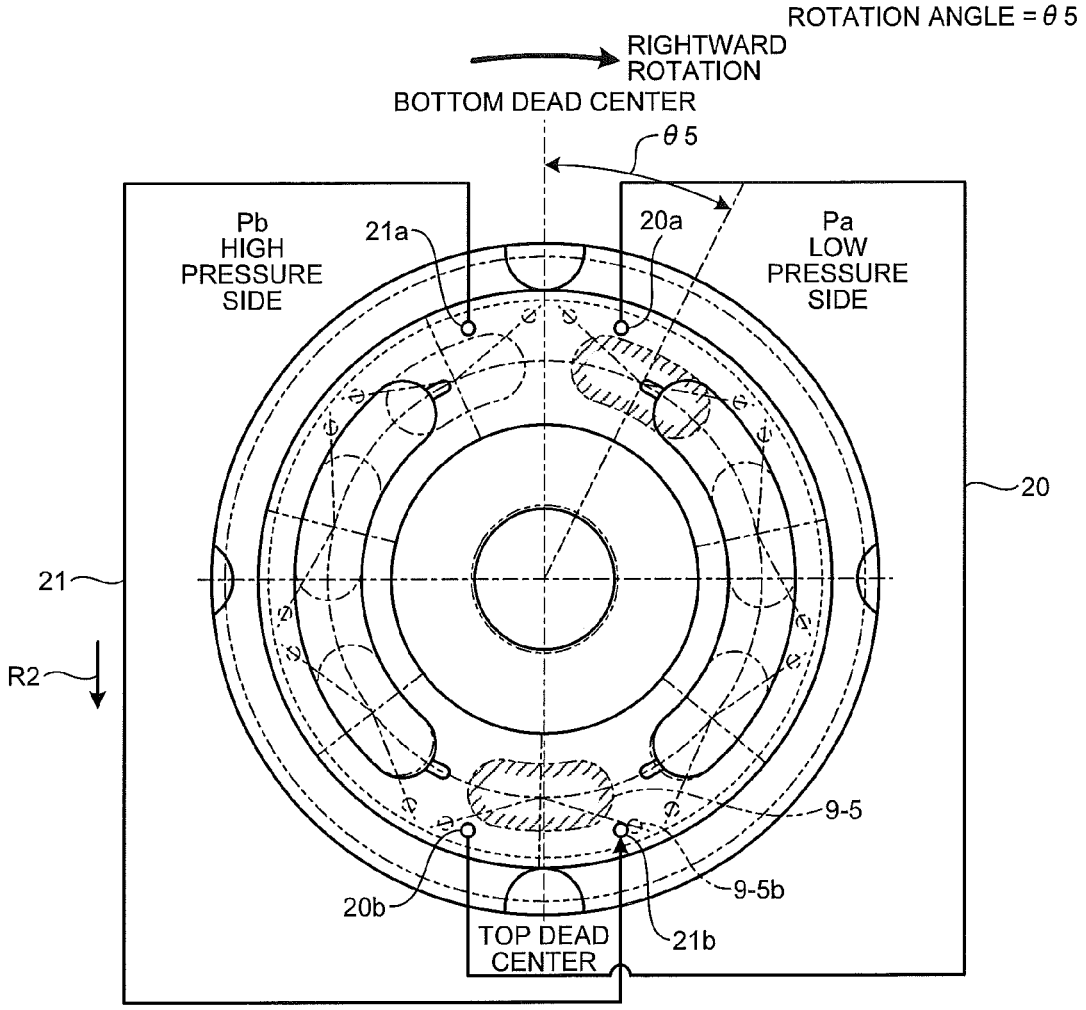
FIG. 11 is a diagram illustrating a positional relation between the valve plate and the cylinder block when an angle obtained by rotating the cylinder block rightward is θ5.

Subsequently, as illustrated in FIG. 11, when the cylinder block 8 further rotates rightward and the angle of the opening center of the cylinder bore 9-1 becomes θ5, the communication hole 9-5*b* which is positioned at the rear rotation side of the cylinder bore 9-5 communicates with the port 21*b* of the pressure accumulation oil passage 21. Since the port 21*a* of the other end of the pressure accumulation oil passage 21 is blocked, the pressure which is accumulated in the pressure accumulation oil passage 21 is supplied into the cylinder bore 9-5 through the communication hole 9-5*b* so as to increase the pressure. That is, an accumulated pressure collection operation R2 is performed. As for the pressure rising operation in this case, since the pressure inside the pressure accumulation oil passage 21 and the pressure inside the cylinder bore 9-5 become a balanced state, the pressure inside the pressure accumulation oil passage 21 and the pressure inside the cylinder bore 9-5 become about ¾ of the pressure accumulated inside the pressure accumulation oil passage 21.

Figure 12:
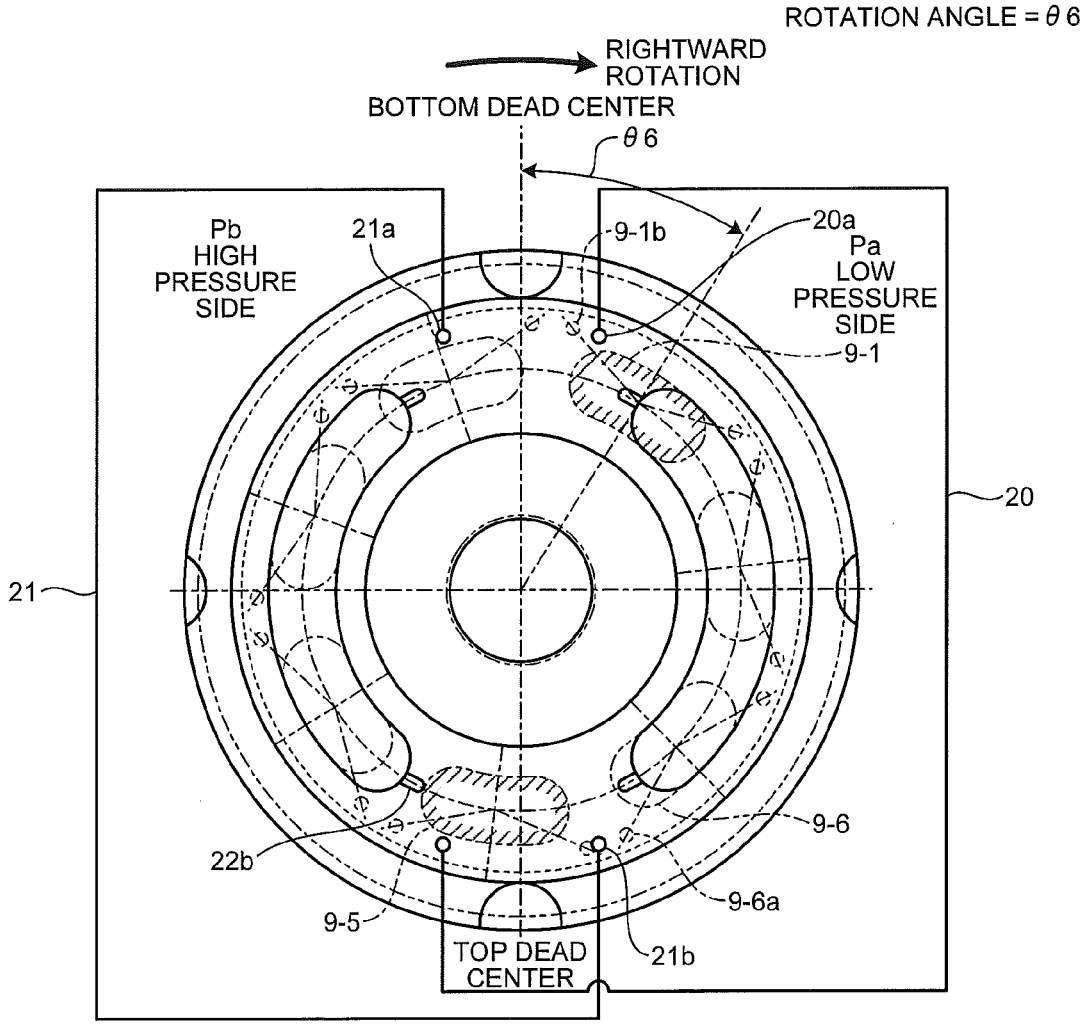
FIG. 12 is a diagram illustrating a positional relation between the valve plate and the cylinder block when an angle obtained by rotating the cylinder block rightward is θ6.
Figure 13:
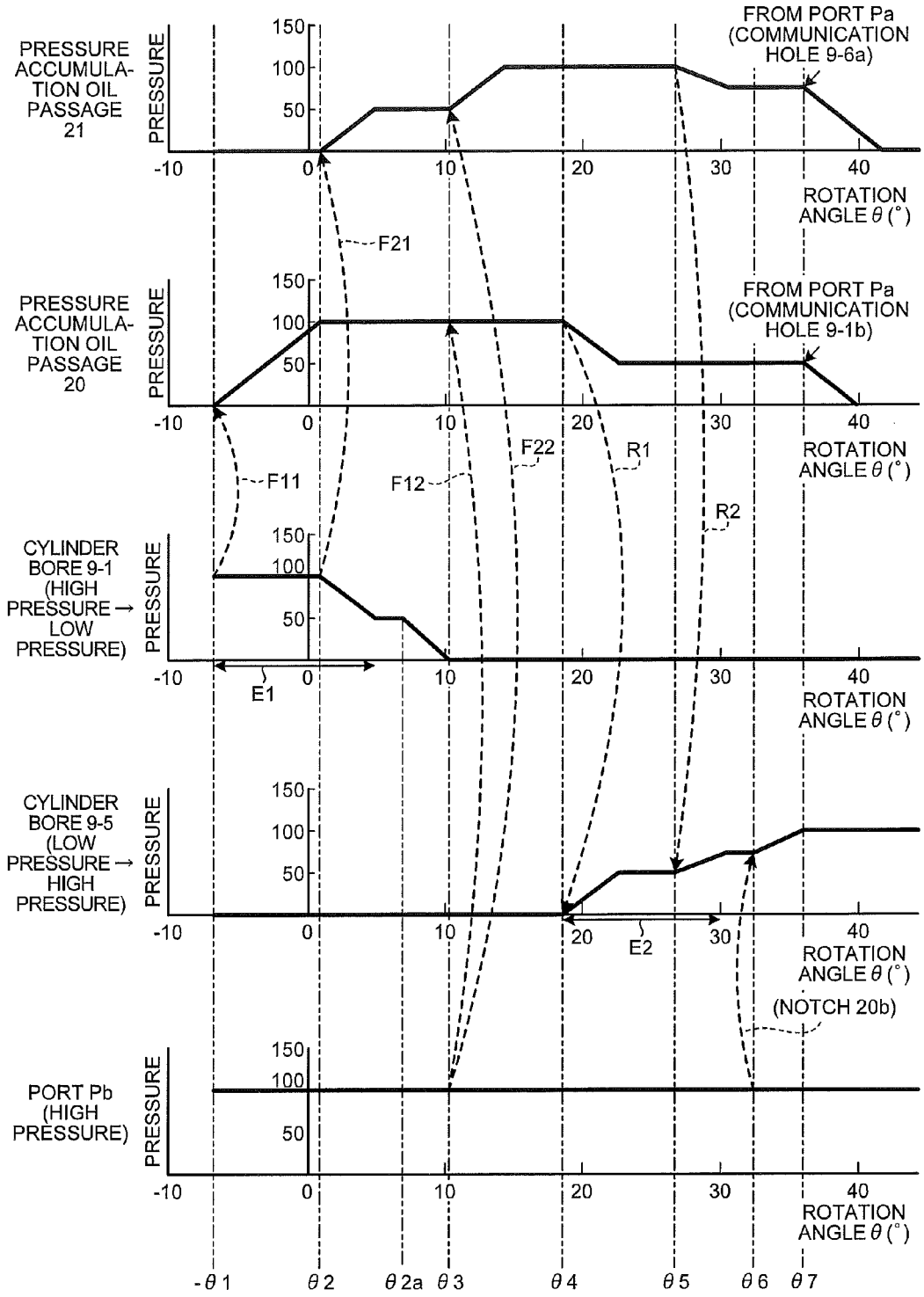
FIG. 13 is a time chart illustrating a change in the pressure of respective portions with the rightward rotation of the cylinder block.

In addition, as illustrated in FIG. 12, when the cylinder block 8 rotates rightward and the angle of the opening center of the cylinder bore 9-1 becomes θ6, the pressure inside the cylinder bore 9-5 rises to the pressure inside the port Pb since the cylinder bore 9-5 communicates with the notch 22*b* of the high pressure side port Pb. Subsequently, when the cylinder block 8 rotates rightward and the angle of the opening center of the cylinder bore 9-1 becomes θ7, referring to FIG. 12, the remaining pressure which is accumulated in the pressure accumulation oil passage 20 falls to the pressure of the low pressure side port Pa since the communication hole 9-1*b* which is positioned at the rear rotation side of the cylinder bore 9-1 communicates with the port 20*a* of the pressure accumulation oil passage 20. On the other hand, the remaining pressure which is accumulated in the pressure accumulation oil passage 21 falls to the pressure of the low pressure side port Pa since the communication hole 9-6*a* positioned at the rotation side of the next cylinder block 9-6 positioned at the rear rotation side of the cylinder bore 9-5 communicates with the port 21*a*.

In this way, with the rotation of the cylinder bore 9, the port 20*a* and the port 20*b* of the pressure accumulation oil passage 20 exclusively communicate with the communication holes 19*a* and 19*b* of the cylinder bore 9, and the port 21*a* and the port 21*b* of the pressure accumulation oil passage 21 exclusively communicate with the communication holes 19*a* and 19*b* of the cylinder bore 9. Then, the pressure which is accumulated in the pressure accumulation oil passages 20 and 21 is used for the two-level pressure rising operation (the accumulated pressure collection operation) when the cylinder bore 9-5 moves from the low pressure side port Pa to the high pressure side port Pb. Actually, since the pressure rising operation is performed by using the communication with the notch 20*b*, a three-level pressure rising operation is performed. In this way, since an abrupt change in pressure is suppressed by gradually changing the pressure inside the cylinder bore, the pulsation of the hydraulic oil may be suppressed.

In this embodiment, the above-described operations and processes are performed at a predetermined rotation angle at which the pressure accumulation operations F11, F12, F21, and F22 and the accumulated pressure collection operations R1 and R2 are performed in the confining areas E1 and E2 using the pressure accumulation oil passages 20 and 21, and herein, (360/7) each time due to the presence of seven cylinder bores 9.

Furthermore, in the description above, only the case in which the cylinder block 8 rotates rightward has been described, but the completely identical operation is performed even when the port Pa is set to the high pressure side and the leftward rotation is performed. In this case, the respective communication holes 19*a* and 19*b* and the respective ports 20*a*, 20*b*, 21*a*, and 21*b* of the pressure accumulation oil passages 20 and 21 are made to have the same arrangement relation in the different rotation direction (the rightward rotation and the leftward rotation) of the cylinder block 8.

Further, in the above-described embodiment, two pressure accumulation oil passages 20 and 21 are configured to intersect each other. That is, the port 20*a* of the pressure accumulation oil passage 20 is disposed at the side of the port Pa near the bottom dead center, the port 20*b* is disposed at the side of the port Pb near the top dead center, the port 21*a* of the pressure accumulation oil passage 21 is disposed at the side of the port Pb near the bottom dead center, and the port 21*b* is disposed at the side of the port Pa near the top dead center. However, two pressure accumulation oil passages 20 and 21 may be arranged in parallel without any intersection. That is, the pressure accumulation oil passage 20 may be connected between the ports 20*a* and 21*b* and the pressure accumulation oil passage 21 may be connected between the port 21*a* and the port 20*b*. In this case, the operations of the pressure accumulation oil passages 20 and 21 after the angle θ4 illustrated in FIG. 13 are reversed, but the pressure rising operation and the pressure reducing operation with respect to the cylinder bores 9-1 and 9-5 are the same.

Furthermore, the respective communication holes 19*a* and 19*b* of the cylinder block 8 and the ports 20*a*, 20*b*, 21*a*, and 21*b* of the valve plate 13 are provided at the outer peripheral side outside the slide and rotation trajectory area of the cylinder bore 9 with respect to the valve plate 13, but the invention is not limited thereto. The holes and ports may be provided at the inner peripheral side outside the slide and rotation trajectory area of the cylinder bore 9. That is, the respective communication holes 19*a* and 19*b* and the ports 20*a*, 20*b*, 21*a*, and 21*b* may be provided outside the slide and rotation trajectory area of the cylinder bore 9.

Further, in the above-described embodiment, the ports 20*a* and 20*b* and the ports 21*a* and 21*b* are disposed at positions which are point-symmetrical to each other with respect to the rotation center and also correspond to the different rotation direction, but the invention is not limited thereto. For example, when the cylinder bores 9 are provided as an even number and the cylinder block 8 is rotated in one direction, the pair of ports 21*a* and 21*b* may be provided at a position shifted in the rotation direction and the communication timing with respect to the communication holes 19*a* and 19*b* may be adjusted.

Furthermore, in the above-described embodiment, the oblique shaft type hydraulic motor has been exemplified, but the invention is not limited thereto. The invention may be also applied to an oblique plate type hydraulic motor. Further, the invention is not limited to the hydraulic motor, but may be also applied to the hydraulic pump. Further, the invention may be also applied to a variable capacity type hydraulic pump/motor.

REFERENCE SIGNS LIST

1 CASING
2 to 4 BEARING
5 OUTPUT SHAFT
6 VALVE CASING
7 CENTER SHAFT
7*a* PRESSURE SPRING
8 CYLINDER BLOCK
9, 9-1 to 9-7 CYLINDER BORE
10 PISTON
11 SPHERICAL PORTION
12 DRIVE DISK
13 VALVE PLATE
19*a*, 19*b* COMMUNICATION HOLE
20, 21 PRESSURE ACCUMULATION OIL PASSAGE
20*a*, 20*b*, 21*a*, 21*b*, PA, PB, Pa, Pb PORT
22*a*, 22*b*, 23*a*, 23*b* NOTCH
F11, F12, F21, F22 PRESSURE ACCUMULATION OPERATION
R1, R2: ACCUMULATED PRESSURE COLLECTION OPERATION

The invention claimed is:

1. An axial type hydraulic pump/motor in which a cylinder block provided with a plurality of cylinder bores slides on a valve plate provided with suction and delivery ports and pistons reciprocate inside the respective cylinder bores to rotate an output shaft or an input shaft rotates to discharge hydraulic oil from the suction and delivery ports, the hydraulic pump/motor comprising:

two pressure accumulation oil passages which accumulate pressure in two connecting passages that are obtained in a manner such that, among two pairs of ports provided on the valve plate and provided at a top dead center side and a bottom dead center side outside a slide and rotation trajectory area of the cylinder bores, a top dead center side port on a front side in a rotation direction of the cylinder block is connected to a bottom dead center side port on the front side in the rotation direction and a top dead center side port on a rear side in the rotation direction is connected to a bottom dead center side port on the rear side in the rotation direction, wherein each cylinder bore includes two communication holes that communicate with inside of the respective cylinder bore and of which opening portions slide on the respective ports with rotation of the cylinder block to communicate with the pressure accumulation oil passages, and wherein each of the ports of each of the pressure accumulation oil passages exclusively communicates with the communication holes so that a pressure accumulation operation is performed in which pressure inside of one of the cylinder bores is in a corresponding one of the pressure accumulation oil passages through one of the communication holes and an accumulated pressure collection operation is performed in which the pressure accumulated in the pressure accumulation oil passage is collected in another of the cylinder bores.

2. The hydraulic pump/motor according to claim 1, wherein the pressure accumulation operation and/or the accumulated pressure collection operation are performed by using the communication holes of adjacent cylinder bores.

3. The hydraulic pump/motor according to claim 1, wherein the pressure accumulation operation and/or the accumulated pressure collection operation are performed when one of the cylinder bores is present in a confining area.

4. The hydraulic pump/motor according to claim 1, wherein the pressure accumulation operation is performed by simultaneously communicating a high pressure side port of one of the pairs of ports, one of the cylinder bores, and one of the pressure accumulation oil passages with one another.

5. The hydraulic pump/motor according to claim 1, wherein the ports of the pressure accumulation oil passage and the communication holes of the cylinder bore have a same arrangement relation in a different rotation direction of the cylinder block.

6. The hydraulic pump/motor according to claim 1, wherein an arc length between the two communication holes of each cylinder bore is longer than an arc length between the pair of ports.

7. The hydraulic pump/motor according to claim 1, wherein the number of the cylinder bores is an odd number, and each pair of ports is disposed to be point-symmetrical to each other with respect to a rotation center.

8. An axial type hydraulic pump/motor in which a cylinder block provided with a plurality of cylinder bores slides on a valve plate provided with suction and delivery ports and pistons reciprocate inside the respective cylinder bores to rotate an output shaft or an input shaft rotates to discharge hydraulic oil from the suction and delivery ports, wherein the valve plate includes a first port which is provided at a position communicating with one of the cylinder bores before the cylinder bore reaches a bottom dead center and immediately before the cylinder bore disconnects from the suction and delivery port, outside a slide and rotation trajectory area of the cylinder bore in a confining area of a bottom dead center side between the suction and delivery ports, a second port which is provided at a position communicating with the cylinder bore after the cylinder bore reaches the bottom dead center and immediately before the cylinder bore communicates with the suction and delivery port and communicating with a following one of the cylinder bores adjacent to the cylinder bore to be present on a same circumference as that of the first port, outside the slide and rotation trajectory area of the cylinder bore in the confining area of the bottom dead center side between the suction and delivery ports, a third port which is provided at a position communicating with the cylinder bore to be present on the same circumference as that of the first port before the cylinder bore reaches the top dead center and immediately before the cylinder bore disconnects from the suction and delivery port, outside the slide and rotation trajectory area of the cylinder bore in a confining area of a top dead center side between the suction and delivery ports, and a fourth port which is provided at a position communicating with the cylinder bore after the cylinder bore reaches the top dead center and immediately before the cylinder bore communicates with the suction and delivery port and communicating with the following cylinder bore adjacent to the cylinder bore to be present on the same circumference as that of the first port, outside the slide and rotation trajectory area of the cylinder bore in the confining area of the top dead center side between the suction and delivery ports, wherein each cylinder bore includes two communication holes that communicate with inside of respective cylinder bore so that openings of the communication holes near the valve plate are provided at the same circumference as those of the first to fourth ports and in which an arc length between the openings is longer than an arc length between the first and second ports and an arc length between the third and fourth ports, a first pressure accumulation oil passage which communicates the first port with the third port, and a second pressure accumulation oil passage which communicates the second port with the fourth port.

9. A method of suppressing a pulsation of axial type hydraulic pump/motor in which a cylinder block provided with a plurality of cylinder bores slides on a valve plate provided with suction and delivery ports and pistons reciprocate inside the respective cylinder bores to rotate an output shaft or an input shaft rotates to discharge hydraulic oil from the suction and delivery ports, the method comprising:

performing a pressure accumulation operation in which each of two pressure accumulation oil passages exclusively communicates via two ports with a corresponding one of a plurality of communication holes and pressure inside one of the cylinder bores, so that pressure is accumulated in a corresponding one of the pressure accumulation oil passages through the communication hole, the two pressure accumulation oil passages being used to accumulate pressure in two connecting passages that are obtained in a manner such that, among two pairs of ports provided on the valve plate and provided at a top dead center side and a bottom dead center side outside a slide and rotation trajectory area of the cylinder bores, a top dead center side port on a front side in a rotation direction of the cylinder block is connected to a bottom dead center side port on the front side in the rotation direction and a top dead center side port on a rear side in the rotation direction is connected to a bottom dead center side port on the rear side in the rotation direction, respective pairs of the plurality of communication holes being provided connecting to each of the cylinder bores to communicate with inside of that cylinder bore and having opening portions sliding on the respective ports with rotation of the cylinder block to communicate with the respective ports; and performing an accumulated pressure collection operation in which the pressure accumulated in the pressure accumulation oil passage is collected in one of the cylinder bores.

* * * * *